US010997956B2

(12) United States Patent
Bodnar et al.

(10) Patent No.: US 10,997,956 B2
(45) Date of Patent: May 4, 2021

(54) STRAP LENGTH ADJUSTING APPARATUS

(71) Applicants: Jonathan Amos Bodnar, Afula (IL); Dror Elkayam, Maalot (IL)

(72) Inventors: Jonathan Amos Bodnar, Afula (IL); Dror Elkayam, Maalot (IL)

( * ) Notice: Subject to any disclaimer, the term of this patent is extended or adjusted under 35 U.S.C. 154(b) by 0 days.

(21) Appl. No.: 16/341,911

(22) PCT Filed: Sep. 10, 2017

(86) PCT No.: PCT/IL2017/051012

§ 371 (c)(1),
(2) Date: Apr. 14, 2019

(87) PCT Pub. No.: WO2018/051333

PCT Pub. Date: Mar. 22, 2018

(65) Prior Publication Data

US 2019/0244591 A1 Aug. 8, 2019

Related U.S. Application Data

(60) Provisional application No. 62/396,162, filed on Sep. 18, 2016.

(30) Foreign Application Priority Data

Sep. 10, 2017 (WO) ..... PCT/IL2017/051012

(51) Int. Cl.
*G10G 5/00* (2006.01)
*A45F 5/00* (2006.01)
(Continued)

(52) U.S. Cl.
CPC ..... *G10G 5/005* (2013.01); *A44B 99/00* (2013.01); *A45C 13/30* (2013.01); *A45F 5/004* (2013.01);
(Continued)

(58) Field of Classification Search
CPC ..... G10G 5/005; A44B 99/00; B65H 75/40; B65H 75/4481; A45C 13/30; A45F 5/004; A45F 2005/006; G10D 1/08
See application file for complete search history.

(56) References Cited

U.S. PATENT DOCUMENTS 4,417,703 A * 11/1983 Weinhold ..... B65H 75/4431 242/378.1
5,178,619 A * 1/1993 Galazaka ..... A61B 18/14 242/378.1
(Continued)

FOREIGN PATENT DOCUMENTS

JP 2002165627 6/2002

OTHER PUBLICATIONS

PCT Search Report PCT/IL2017/051012, dated Dec. 5, 2017.

*Primary Examiner* — Sang K Kim
(74) *Attorney, Agent, or Firm* — Dekel Patent Ltd.; David Klein

(57) ABSTRACT

A strap length adjusting apparatus includes first and second stationary plates and a middle plate disposed between them. The middle plate can rotate relative to the first and second stationary plates. A biasing device is linked to first and second coupling members between the middle plate and the first plate. The biasing device can either couple the middle plate to the first plate or decouple the middle plate from the first plate. When the first and middle plates are decoupled from each other, the middle plate can rotate with respect to the first plate, and a strap partially wound about a rod that extends from the middle plate, can wind about the rod either clockwise or counterclockwise so as to continuously change a length of the strap that extends away from the rod.

10 Claims, 6 Drawing Sheets

(51) Int. Cl.

| | |
|---|---|
| ***A45C 13/30*** | (2006.01) |
| ***A44B 99/00*** | (2010.01) |
| ***B65H 75/40*** | (2006.01) |
| ***B65H 75/44*** | (2006.01) |
| *G10D 1/08* | (2006.01) |

(52) U.S. Cl.
CPC ..... *B65H 75/40* (2013.01); *B65H 75/4481* (2013.01); *A45F 2005/006* (2013.01); *G10D 1/08* (2013.01)

(56) References Cited

U.S. PATENT DOCUMENTS

| | | | | |
|---|---|---|---|---|
| 5,897,039 | A * | 4/1999 | Swenke | A45C 13/26 150/108 |
| 7,093,783 | B2 * | 8/2006 | Warren | B65H 75/48 242/378.1 |
| 7,455,255 | B1 * | 11/2008 | Chao | B65H 75/4431 242/378.1 |
| 7,494,083 | B1 * | 2/2009 | Yen | B65H 75/4431 242/378.1 |
| 2005/0237864 | A1 | 10/2005 | Albisetti | |
| 2014/0097283 | A1 | 4/2014 | So | |
| 2015/0313319 | A1 | 11/2015 | Ha | |
| 2017/0369274 | A1 * | 12/2017 | Joyner | B65H 75/4442 |

* cited by examiner

STRAP LENGTH ADJUSTING APPARATUS

This application is a continuation-in-part national phase of PCT/IL2017/051012, filed Sep. 19, 2017, which claims priority from U.S. Provisional Patent Application 62/396,162, filed Sep. 18, 2016.

FIELD OF THE INVENTION

The invention relates to the field of guitars. More particularly, the invention relates to an apparatus for adjusting the length of the strap thereof.

BACKGROUND

There is a long felt need to provide an apparatus for firmly hold the guitar's strap, while allowing manual adjusting the length thereof.

SUMMARY

A strap length adjusting apparatus, including a first plate, being stationary, a second plate disposed adjacent to the first plate and being rotatable in relation thereto, and a plurality of protrusions, extending from the plates for interlacing them.

DETAILED DESCRIPTION

Figure 1:
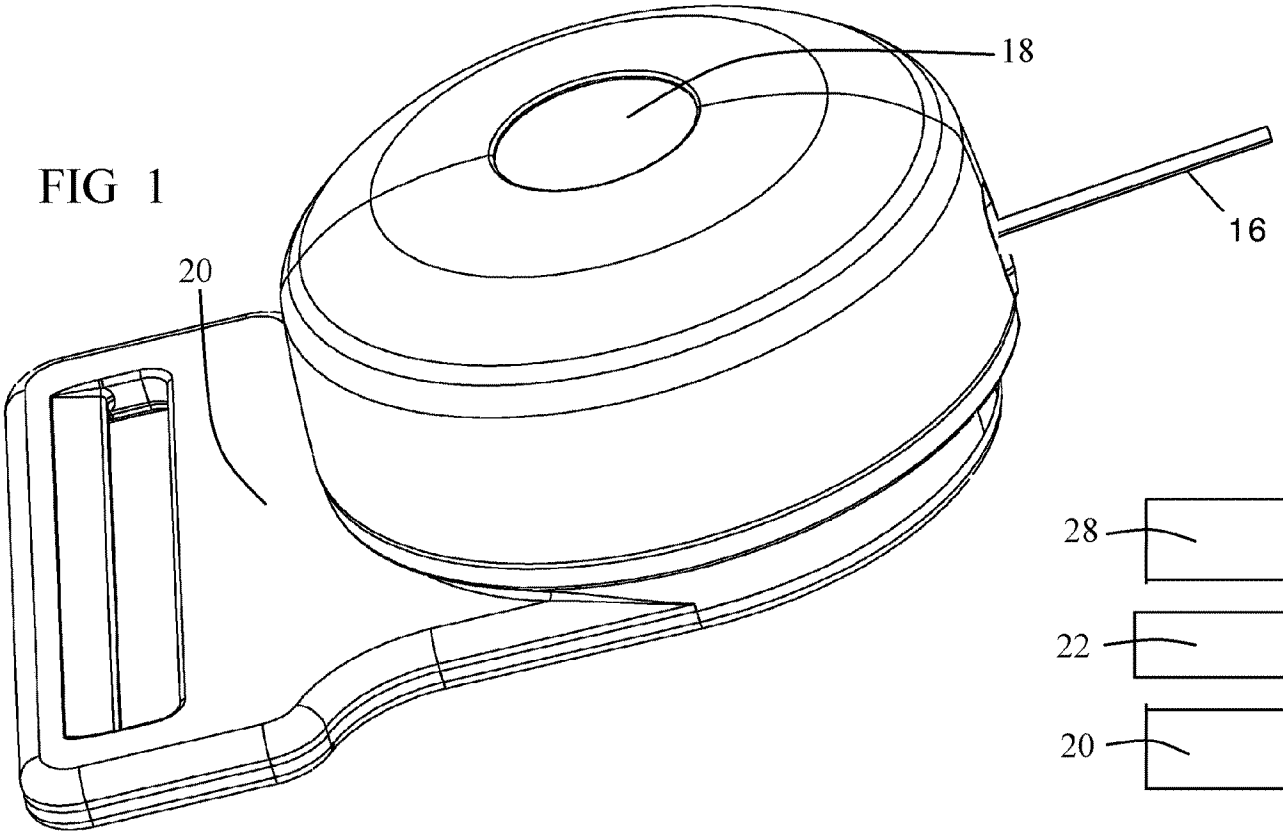
FIG. 1 is a perspective view of a strap length adjusting apparatus according to one embodiment of the invention.

FIG. 1 is a perspective view of a strap length adjusting apparatus according to one embodiment of the invention. A strap length adjusting apparatus 10 includes a push button 18, for pressing it, and then for rotating it in relation to a bottom plate 20, for pulling an extending strap 16, or for releasing it.

Figure 2:
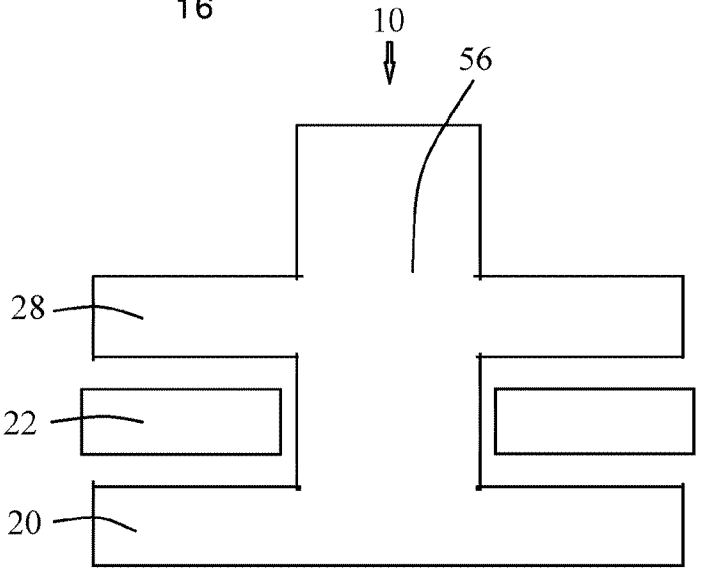
FIG. 2 is a schematic front sectional view of the strap length adjusting apparatus of FIG. 1.

FIG. 2 is a schematic front sectional view of the strap length adjusting apparatus of FIG. 1.

Figure 3:
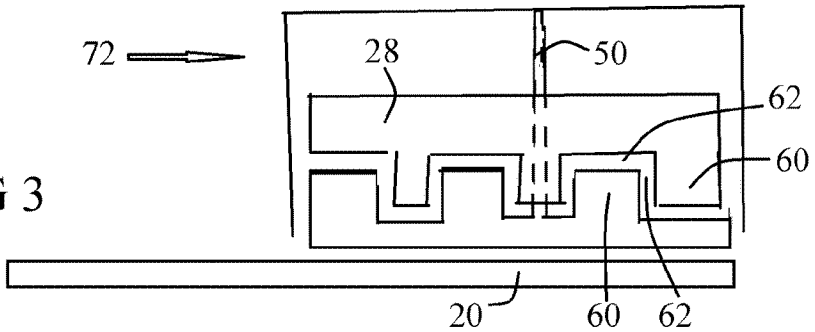
FIG. 3 is another schematic front sectional view of the strap length adjusting apparatus of FIG. 1.

Strap length adjusting apparatus 10 includes a bottom plate 20 and a top plate 28, being fixed one to the other; and a middle plate 22, being rotatable in relation to bottom plate 20 and to top plate 28, about the center 56. FIG. 3 is another schematic front sectional view of the strap length adjusting apparatus of FIG. 1.

However, both middle plate 22 and top plate 28 include peripheral protrusions 60 and depressions 62, being shaped complementary one to the other, such that normally, middle plate 22 may be coupled with top plate 28.

Thus, normally protrusions 60 and depressions 62 do not allow rotation of middle plate 22 in relation to top plate 28. Push button 18 of FIG. 1 pushes a rod 50, being fixed to middle plate 22, towards bottom plate 20, away from top plate 28, thus decoupling middle plate 22 from top plate 28.

Figure 4:
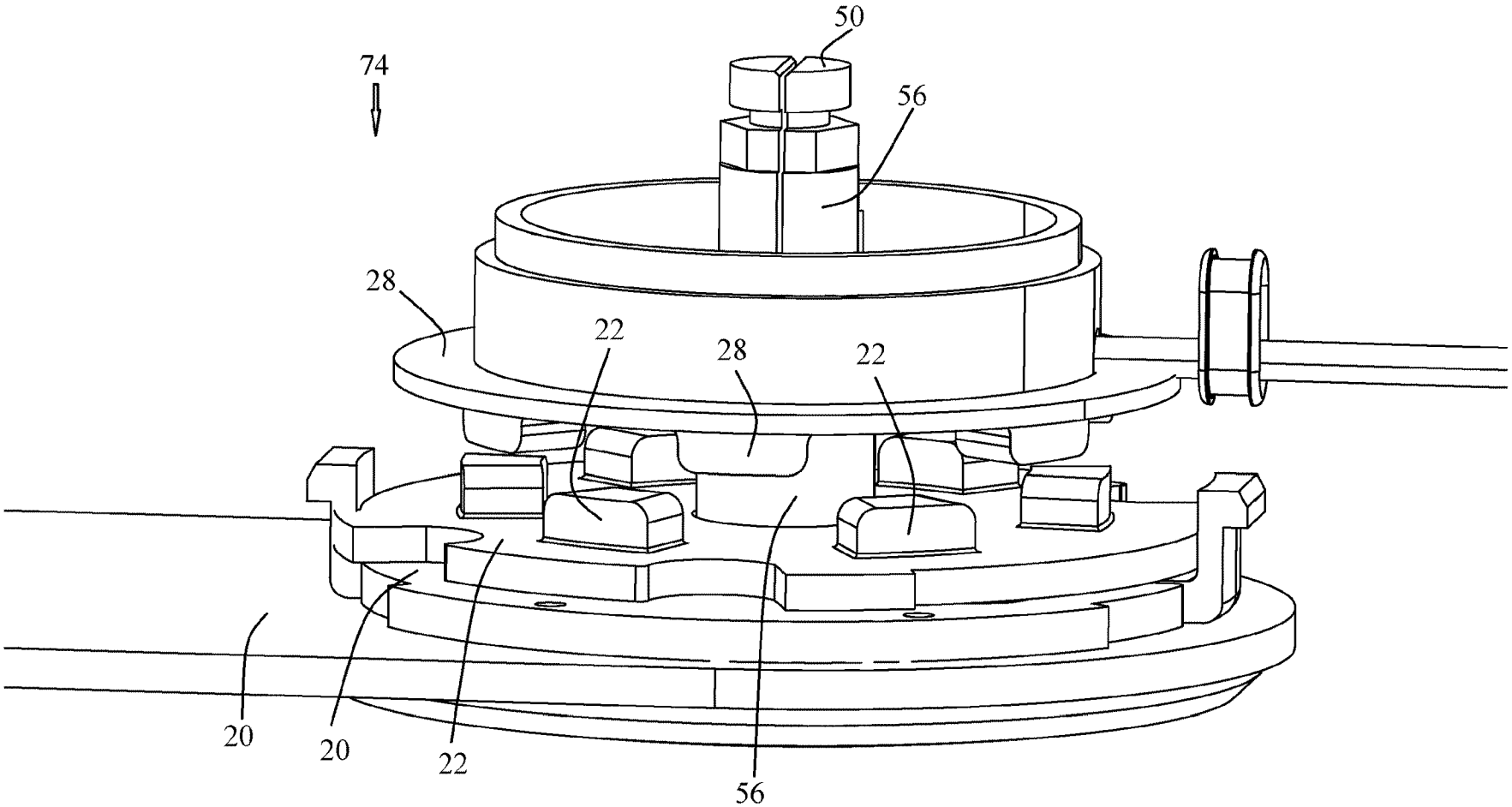
FIG. 4 is a perspective front view of the strap length adjusting apparatus of FIG. 1 without the push button of FIG. 1, at the decoupled state.

FIG. 4 is a perspective front view of the strap length adjusting apparatus of FIG. 1 without the push button of FIG. 1, at the decoupled state.

FIG. 4 is a front perspective view shows the state in which middle plate 22 is not coupled with top plate 28.

At the decoupled state, rotation of button 18 of FIG. 1 rotates rod 50, being fixed to middle plate 22, thus rotating middle plate 22 in relation to top plate 28, and in relation to center 56 fixed thereto.

Figure 5:
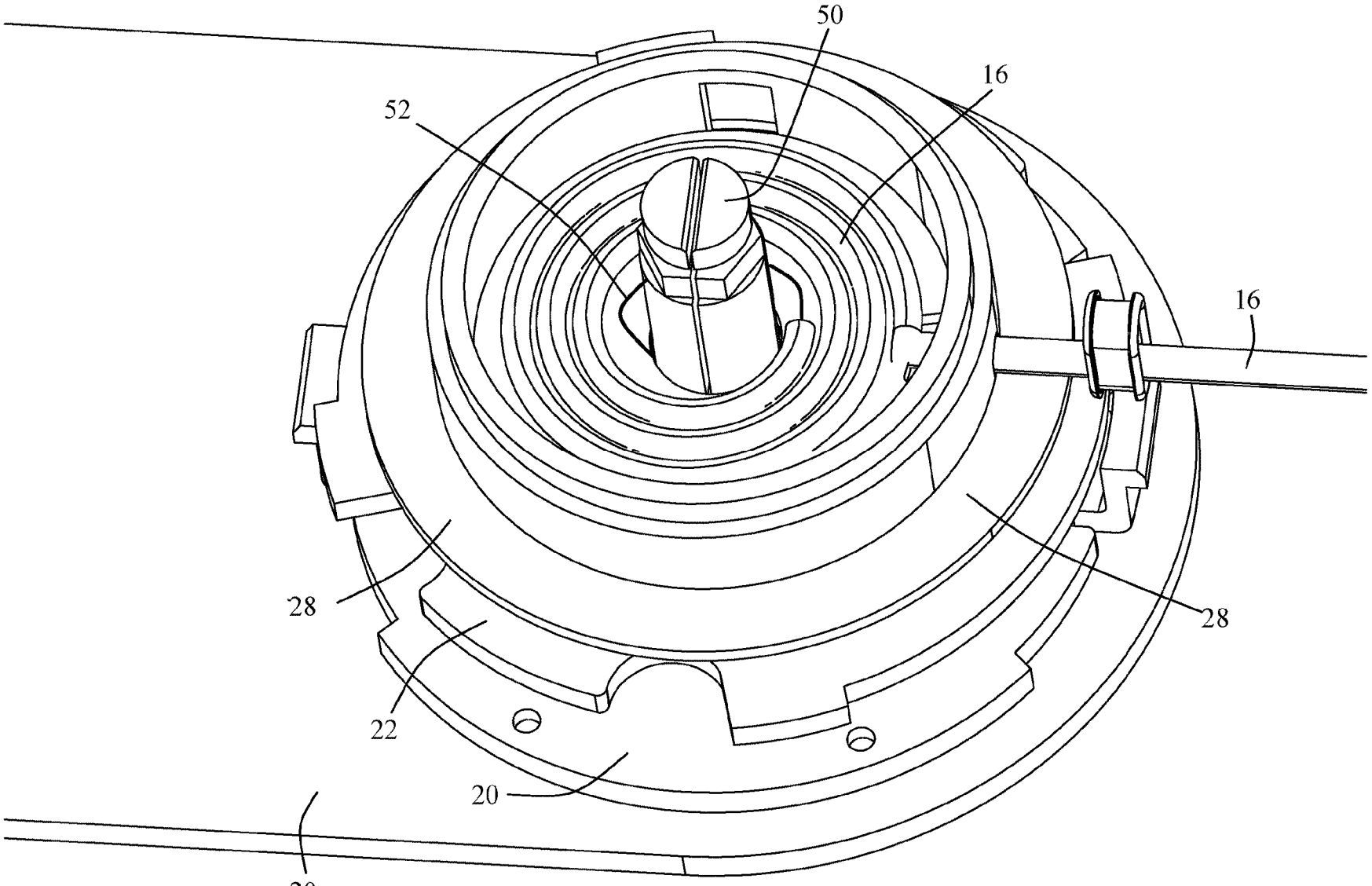
FIG. 5 is a perspective top view of the strap length adjusting apparatus of FIG. 1 without the push button of FIG. 1.

FIG. 5 is a perspective top view of the strap length adjusting apparatus of FIG. 1 without the push button of FIG. 1.

Strap 16 is rolled around rod 50, thus rotation of middle plate 22 together with rod 50 rolls or unrolls strap 16.

A circular spring 52 tends to roll strap 16 around rod 50.

Figure 6:
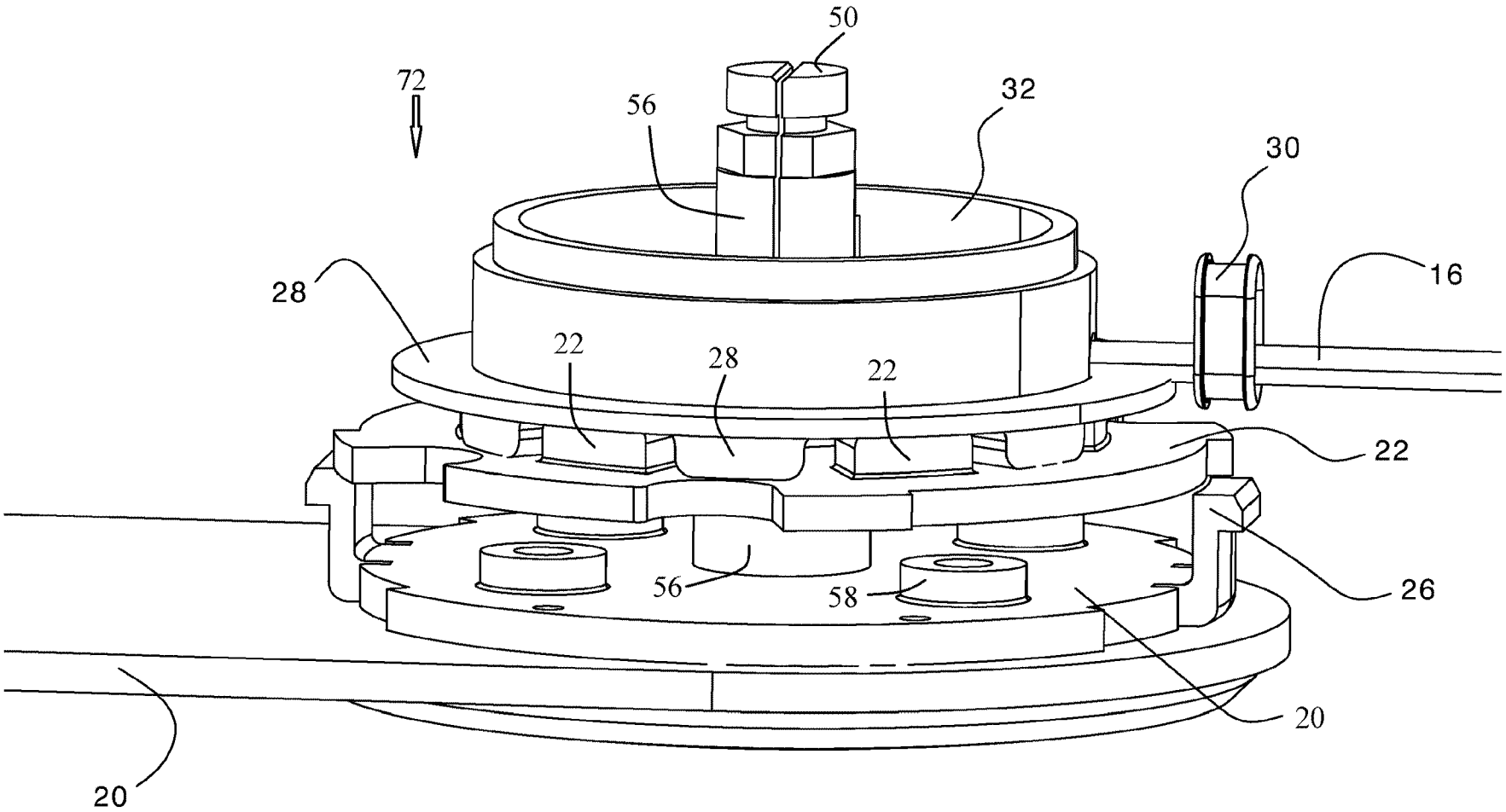
FIG. 6 is a perspective front view of the strap length adjusting apparatus of FIG. 1 without the push button of FIG. 1, at the coupled state.

FIG. 6 is a perspective front view of the strap length adjusting apparatus of FIG. 1 without the push button of FIG. 1, at the coupled state.

Springs 58 normally draw middle plate 22 towards top plate 28, thus coupling them one with the other. The coupling of middle plate 22 with top plate 28 provides strong holding of the length of strap 16.

Figure 7:
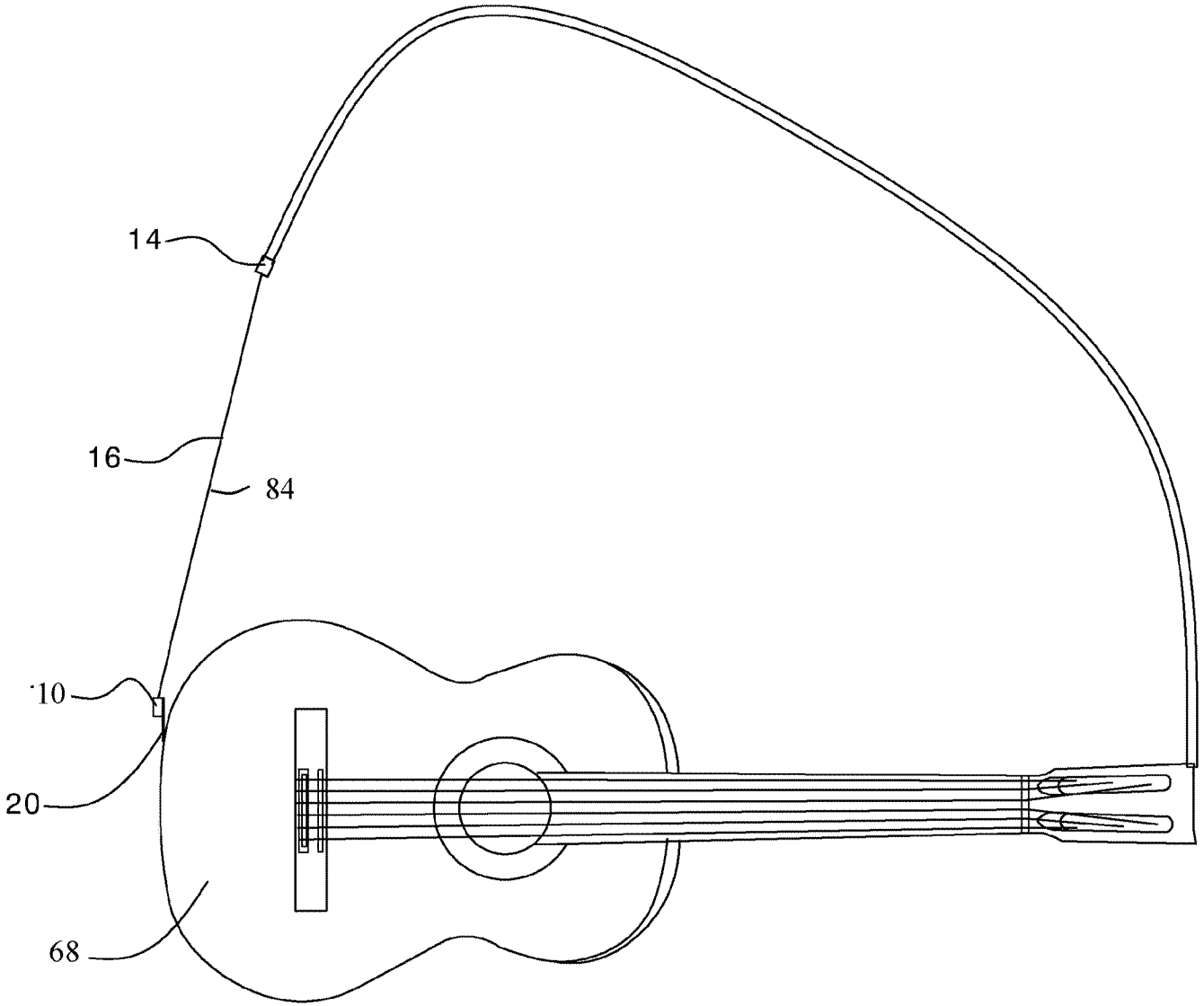
FIG. 7 depicts the use of the strap length adjusting apparatus of FIG. 1.

FIG. 7 depicts the use of the strap length adjusting apparatus of FIG. 1. Strap 16 may be of a guitar 68, thus providing strong adjustment of the length of strap 16, together with simple and immediate changing of the length.

Figure 8:
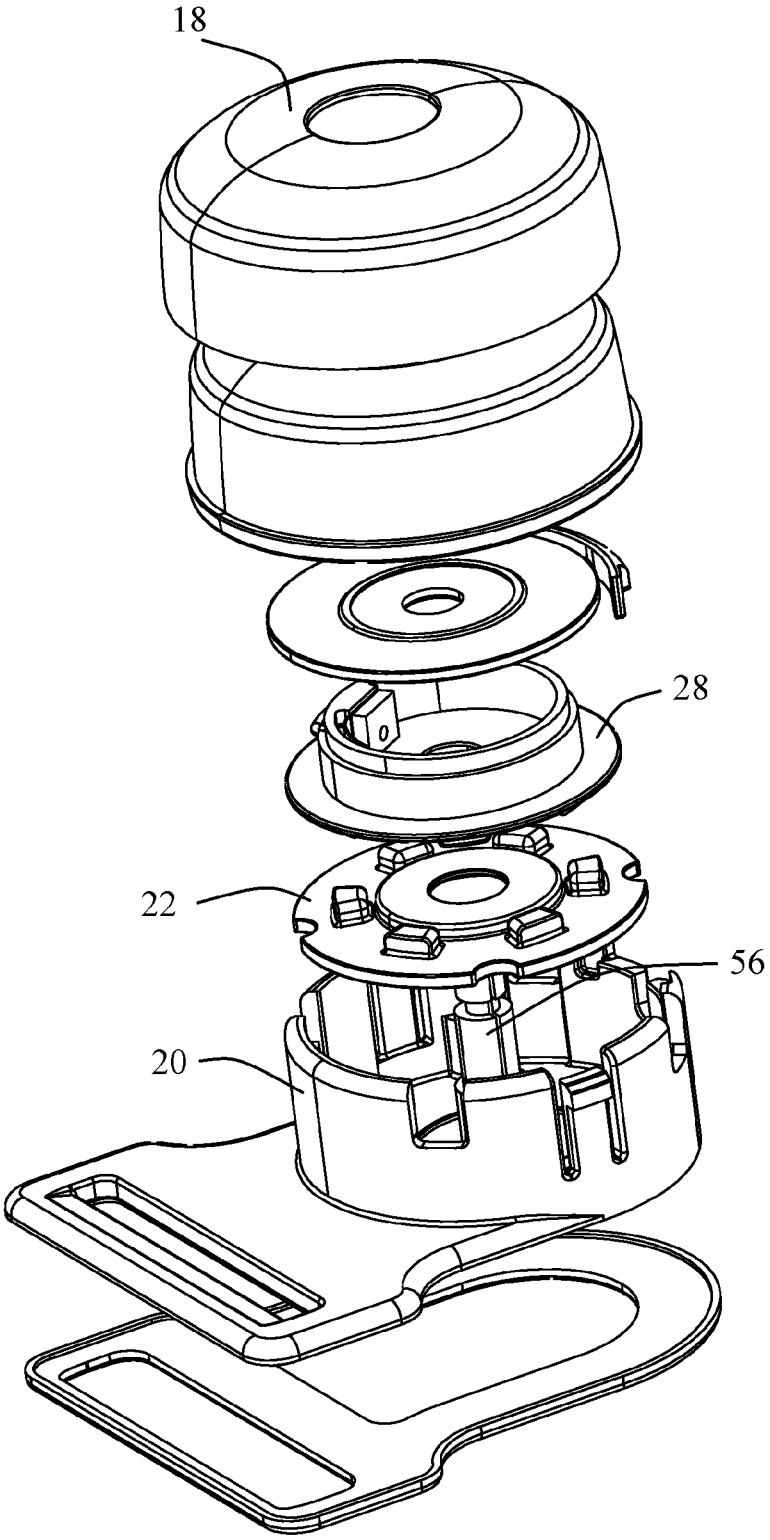
FIG. 8 is a perspective exploded view of the strap length adjusting apparatus of FIG. 1.

FIG. 8 is a perspective exploded view of the strap length adjusting apparatus of FIG. 1.

Numeral 10 denotes the strap length adjusting apparatus according to one embodiment of the invention.

Numeral 16 denotes the strap.

Numeral 18 denotes the push button.

Numeral 20 denotes the bottom plate and/or the surfaces and objects fixed thereto.

Numeral 22 denotes the middle plate.

Numeral 26 denotes a fastening element.

Numeral 28 denotes the top plate.

Numeral 30 denotes a strap outlet.

Numeral 32 denotes a cartridge for the rolled strap, the cartridge extending from the middle plate.

Numeral 50 denotes the rod, for being pressed, for drawing the middle plate 22 away from the top plate 28. Rod 50 may, in principle rotate middle plate 22; however, the rotation may be applied by rotational spring 52 and by manually pulling strap 16, each to a different rotational direction. Numeral 52 denotes a circular spring.

Numeral 56 denotes the center of the plates, which might function as an axle for rotating the middle plate 22 in relation to the top and bottom plates.

Numeral 60 denotes a protrusion.

Numeral 62 denotes a depression.

Numeral 72 denotes the coupled state.

Numeral 74 denotes the decoupled state.

In the decoupled state, the strap may be adjusted to any continuous, not discrete, length (shortened or lengthened). This is in contrast to prior art mechanisms in which the length is adjusted by increments in accordance with discrete stop positions. In the decoupled state, the guitar (or other object being held by the strap) does not fall. Instead the biasing device (e.g., rotational spring 52) is selected to have a biasing strength to maintain the object in place until the user lengthens or shortens the strap. That is, the biasing device is configured to counteract a weight of the object so that the object does not move downwards by gravitational force.

In summary, the strap length adjusting apparatus 10 includes a first stationary element 28, a second stationary element 20, and a middle element 22 positioned between the first and second elements 28 and 20. The middle element 22 is rotatable with respect to the first and second elements 28 and 20. There are first and second coupling members 60 and 62 on the first stationary element 28 and the middle element 22, respectively.

A biasing device 58 is linked to the first and second coupling members 60 and 62. The biasing device 58 has a first operational position in which the first and second coupling members 60 and 62 are coupled with each other such that the middle element 22 cannot rotate with respect to the first stationary element 28, and has a second operational position in which the first and second coupling members 60 and 62 are decoupled from each other such that the middle element 22 can rotate with respect to the first stationary element 28.

A strap 16 is partially wound about a rod 50 that extends from the middle element 22. In the second operational position, rod 50 rotates with middle element 22 so that strap 16 winds about rod 50 either clockwise or counterclockwise so as to continuously change a length of the strap 16 that extends away from rod 50. In the first operational position, rod 50 cannot rotate with middle element 22 so that strap 16 cannot wind about rod 50.

An object 68 (such as a guitar) is attached to strap 16 and to second stationary element 20. In the second operational position, the biasing device 58 is configured to counteract a weight of the object 68 so that the object 68 does not move downwards by gravitational force.

The biasing device 58 is coupled to a push button 18, wherein depressing the push button 18 brings the biasing device 58 from the first operational position to the second operational position.

What is claimed is:

1. A strap length adjusting apparatus comprising:

a first stationary element;

a second stationary element;

a middle element positioned between said first and second elements, said middle element being rotatable with respect to said first and second elements;

first and second coupling members on said first stationary element and said middle element, respectively;

a biasing device linked to said first and second coupling members, said biasing device having a first operational position in which said first and second coupling members are coupled with each other such that said middle element cannot rotate with respect to said first stationary element, and said biasing device having a second operational position in which said first and second coupling members are decoupled from each other such that said middle element can rotate with respect to said first stationary element;

a strap partially wound about a rod that extends from said middle element, wherein in said second operational position, said rod rotates with said middle element so that said strap winds about said rod either clockwise or counterclockwise so as to continuously change a length of said strap that extends away from said rod, and wherein in said first operational position, said rod cannot rotate with said middle element so that said strap cannot wind about said rod; and an object attached to said strap and to said second stationary element, wherein said biasing device has a biasing strength to maintain said object in place during winding of said strap about said rod either clockwise or counterclockwise without said object being held in place by means of any force external to said biasing device.

2. The strap length adjusting apparatus according to claim 1, wherein in said second operational position said biasing device is configured to counteract a weight of said object so that said object does not move downwards by gravitational force.

3. The strap length adjusting apparatus according to claim 1, wherein said biasing device is coupled to a push button, wherein depressing said push button brings said biasing device from said first operational position to said second operational position.

4. The strap length adjusting apparatus according to claim 1, wherein said object is a musical instrument.

5. The strap length adjusting apparatus according to claim 1, wherein said object is a guitar.

6. A method for adjusting a length of a strap comprising:

providing a first stationary element;

providing a second stationary element;

providing a middle element positioned between said first and second elements, said middle element being rotatable with respect to said first and second elements;

providing first and second coupling members on said first stationary element and said middle element, respectively;

providing a biasing device linked to said first and second coupling members;

providing a strap partially wound about a rod that extends from said middle element and selectively placing said biasing device either in a first operational position in which said first and second coupling members are coupled with each other such that said middle element cannot rotate with respect to said first stationary element, or in a second operational position in which said first and second coupling members are decoupled from each other such that said middle element can rotate with respect to said first stationary element;

wherein in said second operational position, said rod rotates with said middle element so that said strap winds about said rod either clockwise or counterclockwise so as to continuously change a length of said strap that extends away from said rod, and wherein in said first operational position, said rod cannot rotate with said middle element so that said strap cannot wind about said rod; and further comprising attaching an object to said strap and to said second stationary element, wherein said biasing device has a biasing strength to maintain said object in place during winding of said strap about said rod either clockwise or counterclockwise, and wherein a user of said strap does not hold said object and only said biasing device holds said object in place during winding of said strap about said rod.

7. The method according to claim 6, wherein in said second operational position said biasing device counteracts a weight of said object so that said object does not move downwards by gravitational force.

8. The method according to claim 6, wherein said biasing device is coupled to a push button, wherein depressing said push button brings said biasing device from said first operational position to said second operational position.

9. The method according to claim 6, wherein said object is a musical instrument.

10. The method according to claim 6, wherein said object is a guitar.

* * * * *